US005515680A

United States Patent [19]

Fujimura et al.

[11] Patent Number: 5,515,680

[45] Date of Patent: May 14, 1996

[54] APPARATUS AND METHOD FOR MIXING GASEOUS FUEL AND AIR FOR COMBUSTION INCLUDING INJECTION AT A REVERSE FLOW BEND

[75] Inventors: Hidekazu Fujimura, Mito; Kazuhito Koyama, Hitachi; Shozo Nakamura, Hitachioota; Yoshikazu Moritomo, Hitachi, all of Japan

[73] Assignee: Hitachi, Ltd., Tokyo, Japan

[21] Appl. No.: 214,753

[22] Filed: Mar. 18, 1994

[30] Foreign Application Priority Data

Mar. 18, 1993 [JP] Japan ..... 5-059148

[51] Int. Cl.[6] ..... F23R 3/54

[52] U.S. Cl. ..... 60/737; 60/760; 239/434

[58] Field of Search ..... 60/39.36, 737, 60/743, 747, 748, 760; 239/434

[56] References Cited

U.S. PATENT DOCUMENTS

| | | | |
|---|---|---|---|
| 4,561,257 | 12/1985 | Kwan et al. | 60/737 |
| 4,766,721 | 8/1988 | Iizuka et al. | 60/747 |
| 4,898,001 | 2/1990 | Kuroda et al. . | |
| 5,069,029 | 12/1991 | Kuroda et al. | 60/737 |
| 5,081,843 | 1/1992 | Ishibashi et al. | 60/748 |
| 5,121,597 | 6/1992 | Urushidani et al. | 60/747 |
| 5,216,885 | 6/1993 | Taniguchi et al. | 60/747 |

FOREIGN PATENT DOCUMENTS

| | | |
|---|---|---|
| 388886 | 9/1990 | European Pat. Off. . |
| 59-108054 | 7/1984 | Japan . |
| 61-22127 | 1/1986 | Japan . |
| 62-294815 | 12/1987 | Japan . |

*Primary Examiner*—Timothy S. Thorpe

*Attorney, Agent, or Firm*—Fay, Sharpe, Beall, Fagan, Minnich & McKee

[57] ABSTRACT

An apparatus for mixing gaseous fuel and air for combustion, particularly premixing-type combustion in a gas turbine, has a conduit providing a passage for flow of the air with a reverse bend defined by opposed first and second wall portions that bound respectively the outside and the inside of said reverse bend as seen in a longitudinal section. The reverse bend establishes a flow region of air having a velocity gradient extending transversely across the conduit from a high velocity zone adjacent the first side wall portion at the outside of the reverse bend to a low velocity zone. Injection means for the gaseous fuel injects the fuel from the first side wall portion into the high velocity zone with a velocity component transverse to the air flow and in a direction towards the low velocity zone. Rapid and uniform mixing is obtained.

19 Claims, 5 Drawing Sheets

APPARATUS AND METHOD FOR MIXING GASEOUS FUEL AND AIR FOR COMBUSTION INCLUDING INJECTION AT A REVERSE FLOW BEND

BACKGROUND OF THE INVENTION

1. Field of the Invention

This invention relates to an apparatus and a method for mixing gaseous fuel and air for combustion, and particularly for the mixing of gaseous fuel and air in a premixing combustion air passage of a combustor of a gas turbine. While the apparatus and method of the invention can be applied to mixing of fuel and air for various purposes, explanation will primarily be made below in relation to gas turbine combustors or burners.

2. Description of the Related Art

Gas turbine burners which can operate in two combustion modes have become generally adopted. JP-A-61-22127 (corresponding to U.S. Pat. No. 4,898,001) discloses a gas turbine burner which employs diffusion combustion using multiple nozzles and premixing combustion also using multiple nozzles. Low temperature combustion using excess air is generally performed, in order to reduce NOx production. However, an extremely wide range of fuel supply rate is required from ignition up to rated load, in gas turbine combustion, making it impossible to cover this broad range wholly by premixing combustion. Therefore it is necessary to employ diffusion combustion over a range of combustion rate from ignition up to a certain speed of rotation of the gas turbine or to a certain load level.

In diffusion combustion, there is a tendency for high temperature areas to occur locally, leading to a higher emission level of NOx. Therefore it is desirable to switch to premixing combustion, giving a uniform and low temperature combustion with excess air, as soon as possible in order to reduce NOx. Accordingly, startup of the gas turbine is effected with diffusion combustion at the time of ignition, and then the burner is gradually switched to premixing combustion, with support from the diffusion combustion flame, when the ratio of air and fuel reaches the limit for premixing combustion.

Particularly at low fuel supply rates, even in premixing combustion, low NOx production may not be achieved at all times. What is required is to achieve a uniform mixing of the fuel into the premixing combustion air.

JP-A-61-22127 mentioned above describes the supply of fuel locally into the premixing combustion air flow through a plurality of nozzles, but it has been found that concentration distribution of the fuel in the air is inconsistent, when changes occur in the volume of air flow or velocity of fuel injection. In particular, the locus of the injected fuel, after injection into the air may change considerably, with change of load. Uneven fuel distribution leads to higher NOx production.

JP-A-62-294815 shows injection of fuel from a nozzle located centrally in an air flow passage, at a straight portion of the passage. Reliance is therefore placed upon mixing of the fuel and air as they pass along the passage, but no special measures are taken.

In the construction shown in JP-U-59-108054, fuel is injected in a radially outward direction with respect to the access of the burner into a venturi region of an air flow passage. The fuel is injected from a radially inner cylindrical wall portion of the air passage towards a convexly curved radially outer wall portion of the passage. Here again reliance is placed on mixing of the air and fuel downstream of the fuel injection region, in an approximately straight part of the air passage.

SUMMARY OF THE INVENTION

The object of the present invention is to provide an apparatus and method of mixing of air and fuel for combustion, particularly premixing combustion in a gas turbine burner, in which concentration distribution of the fuel in the air is maintained with a high degree of uniformity, despite changes in load of the burner, i.e. changes in air volume or fuel volume.

The invention provides an apparatus for mixing gaseous fuel and air, in premixing combustion in a gas turbine, having a conduit providing an air passage for the air, characterized in that the conduit has, as seen in longitudinal section, a reverse bend around a member defining an apex of the bend, and there are means for injecting the gaseous fuel into the air flow in a direction towards the apex of the bend from a wall portion of the conduit opposite the apex. The effect of this construction is that the reverse bend establishes in the conduit a flow region of air having a velocity gradient extending transversely across the conduit from a high velocity zone adjacent a first side wall portion at the outside of the reverse bend to a low velocity zone remote from this first side wall portion. Injecting the gaseous fuel from the first side wall portion into the high velocity zone with a velocity component transverse to the air flow and in a direction towards the low velocity zone causes rapid and uniform mixing of the gaseous fuel into the air.

Typically the reverse bend effects reversal of the flow direction of the air from a first direction to a second direction at 180° to the first direction, and the direction of injection of the gaseous fuel is substantially parallel to the second direction. This provides especially good mixing downstream of the bend.

Preferably the member defining the apex of said reverse bend is a partition separating respective upstream and downstream concentric annular portions of the air conduit. This provides a compact and relatively simple construction. The end of the partition, defining the apex of the bend is preferably enlarged, to smooth air flow around the bend.

The invention further provides a combustor for a gas turbine, adapted to operate in premixing combustion mode, having a combustion zone and a conduit providing a path for supply of combustion air to the combustion zone, which path includes a reverse bend as seen in longitudinal section, the combustor further having means for injecting gaseous fuel into the combustion air at the reverse bend in a direction transverse to the air flow and from the outside of the reverse bend towards the inside thereof.

The path for combustion air preferably includes a mixing zone downstream of the reverse bend, the direction of injection of gaseous fuel at the reverse bend being substantially parallel to the flow direction in the mixing zone.

The invention also provides a method of effecting premixing of gaseous fuel and air for combustion in a gas turbine, comprising the steps of causing an air flow to perform a reverse bend and injecting the gaseous fuel into the air flow at the reverse bend in a direction transverse to the air flow direction at the point of injection and from the outside of the reverse bend towards the inside thereof.

BRIEF INTRODUCTION OF THE DRAWINGS

Embodiments of the invention will now be described by way of non-limitative example, with reference to the accompanying drawings, in which.

DESCRIPTION OF PREFERRED EMBODIMENTS

Figure 1:
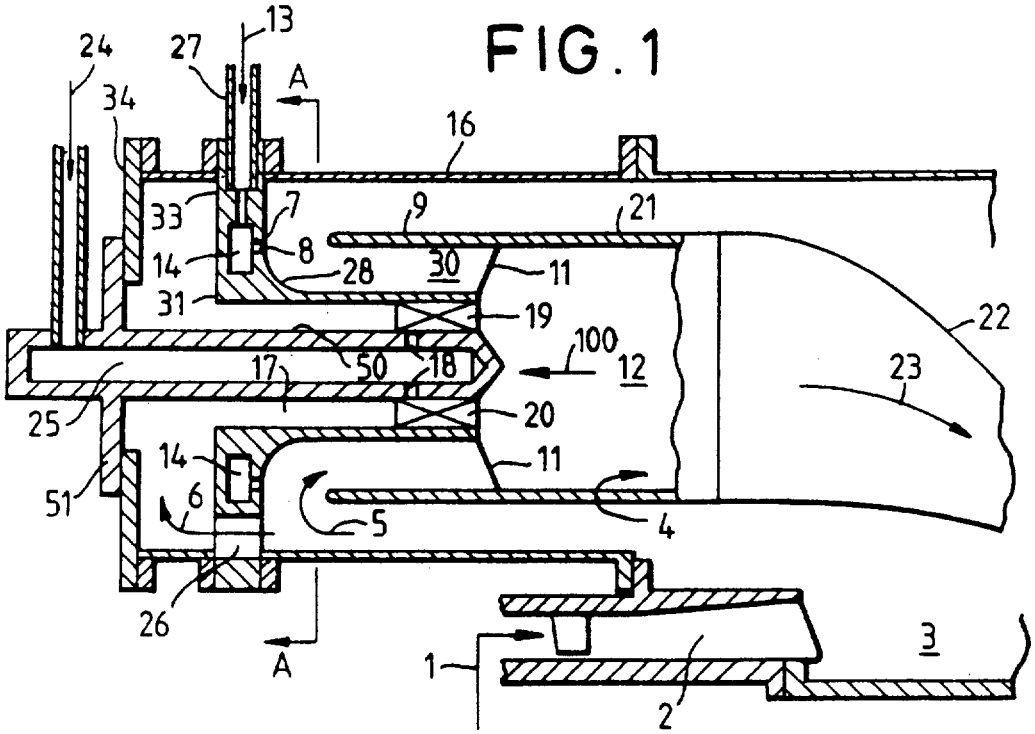
FIG. 1 is an axial cross section of a gas turbine burner equipped with the fuel-air mixing device of the present invention.

The gas turbine burner or combustor of FIGS. 1 to 4 is one of a plurality of identical burners arranged around the axis of the gas turbine (not shown). Each burner burns fuel in air to provide combustion gases to drive the gas turbine. The burner is itself generally symmetrical about its own axis 100.

The burner has an outer cylindrical wall 16 and concentric therewith a cylindrical partition wall 9, part of which forms a burner liner 21 bounding a combustion chamber 12. Air and fuel mixtures are supplied to the combustion chamber 12 for combustion in two modes, premixing combustion and diffusion combustion, as described in more detail below.

At one side of the burner is an air chamber 3 and an air diffuser 2. A flow 1 of compressed air from the gas turbine compressor (not shown) is supplied to the air chamber 3 after a static pressure increase in the diffuser 2. Part of the compressed air from the air chamber 3 is supplied, as indicated by arrow 4, as cooling air for the burner liner 21 through a large number of perforations in the liner 21. The remainder of the air passes along the annular passage between the outer wall 9 and the partition wall 16.

Mounted on the outer wall 16 by struts 33 is a ring member 31, which at its inner periphery carries a generally cylindrical member 28 concentric with the walls 9,16 and extending towards the combustion chamber 12. The members 31 and 28 are secured together by bolts 29 (see FIG. 3 for this detail not shown in FIG. 1). Mounted on an end wall 34 of the combustor by a flange 51 is a tubular member 50, in which there is a diffusion combustion fuel passage 25. Between the tubular member 50 and the inner wall of the ring member 31 and the member 28 is an annular passage 17 for diffusion combustion air. At the downstream end of this passage 17 there are openings 18 from the diffusion fuel passage 25 and vanes 19 which impart swirling motion to the fuel/air mixture as it enters the combustion chamber 12 at diffusion burner opening 20.

Between the struts 33 are openings 26, by which part of the air passes as a flow 6 towards the passage 17. The remainder of the air, which forms the premixing combustion air, passes around the free end of the partition wall 9 as indicated by arrow 5, reversing its direction by 180° and passing along an annular passage 30 between the member 28 and the wall 9 to an annular premixing combustion inlet 11 to the combustion chamber 12.

Figure 3:
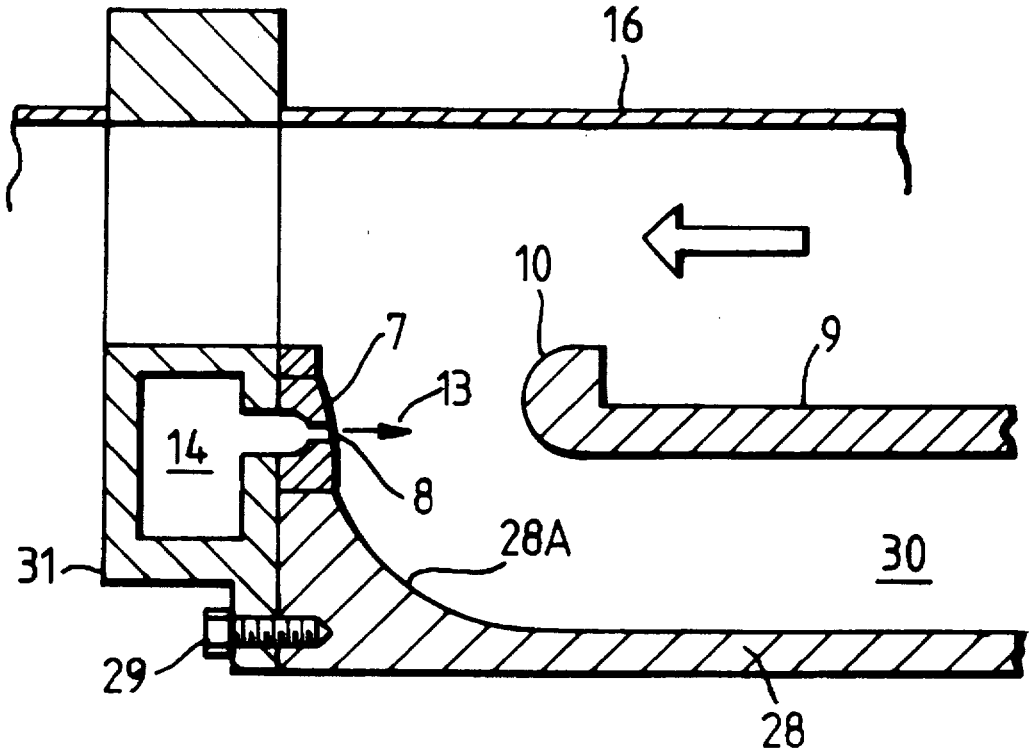
FIG. 3 is an axial cross section showing details of a fuel-air mixing device of the present invention, similar to that of FIG. 1.

A flow 13 of gaseous fuel for the premixing combustion is supplied via a pipe 27 and through one of the struts 33 into an annular chamber 14 within the ring member 31, and from there passes through a large number of fuel injection openings 8 each in fuel nozzle bodies 7 which are mounted on the ring member 31 (as shown in detail in FIG. 3). Each fuel injection opening 8 has a diameter of 2 mm. The premixing combustion fuel is thus injected in the direction indicated by arrow 13 in FIG. 3 transversely to the flow direction of the premixing combustion air, at the outside of a 180° bend in the flow path of the premixing combustion air. The direction of injection is parallel to the flow direction of the premixing combustion air in the passage 30 downstream of the 180° bend, and is directed towards the free end of the wall 9 which forms the apex at the inside of the 180° bend. As FIG. 3 shows, the free end of the member 9 has an enlarged portion 10 providing a convex curved outer surface defining the inside of the 180° bend.

Figure 2:
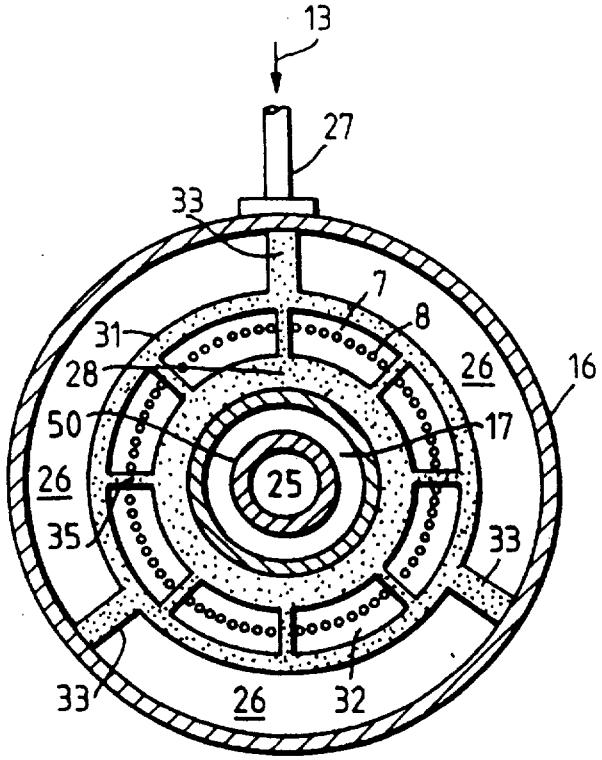
FIG. 2 is a cross section along line A—A in FIG. 1.
Figure 4:
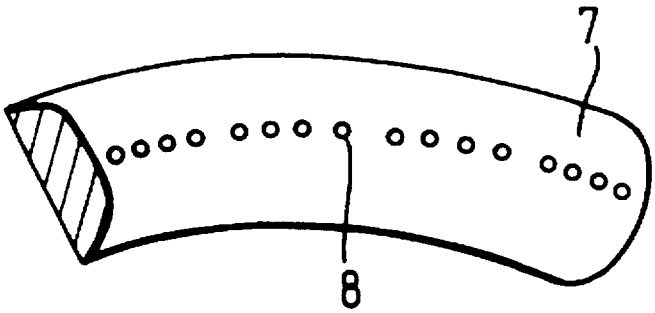
FIG. 4 is a perspective view of a fuel nozzle part used in the fuel-air mixing device of FIG. 3.

As FIG. 2 shows, there are eight of the fuel nozzle bodies 7, arranged in a ring and separated by partitions 35. FIG. 4 is a perspective view of one of the fuel nozzle bodies 7, and shows that the outward face of the this fuel nozzle body 7 is a curved surface with sixteen fuel injection openings 8 located on an arc of a circle. In total, therefore, there are 128 openings 8, at closely spaced intervals in a circle around the burner, which causes a highly uniform distribution of the fuel into the premixing combustion air, in the circumferential direction. As mentioned, and as FIG. 2 shows, the premixing combustion air passage is divided circumferentially into eight sectors 32 by the partitions 35, but a larger number of these partitions may be employed, for example thirty-two partitions, with four fuel openings 8 leading to each sector.

The diffusion combustion fuel is supplied as a flow 24 into the passage 25, and passes from there through the opening 18 into the flow of diffusion combustion air, at the vanes 19. Combustion of this fuel starts at the diffusion burner opening 20, and continues inside the combustion chamber 12. Likewise the premixing air/fuel mixture starts premixing combustion at the premixing combustion inlet 11 and burns inside the combustion chamber 12. Combustion is supported by the diffusion flame during initial rotation of the gas turbine and up to a certain level of partial load. As the load increases up to the rated load, the ratio of premixing combustion is gradually increased in order to achieve a low NOx production. At the rated load, the diffusion fuel flow can be reduced to zero although a very small amount of diffusion fuel can be supplied to stabilize the flame. The high temperature flow 23 of combustion gases from combustion in the combustion chamber 12 passes through a transition piece 22 to the gas turbine entry (not shown) and drives the gas turbine. As mentioned there is an array of similar burners around the axis of the turbine.

As described above, the premixing air flow 5 passes around a 180° reverse bend joining two concentric annular passage portions. This reverse bend has at its outside the fuel nozzle bodies 7 and at its inside the convexly curved enlarged end 10 of the wall 9. The member 28 has a curved surface portion 28A which assists the smooth flow of the air around this bend. Downstream of the bend, in the annular passage between the member 28 and the member 9, the fuel and air mix in a mixing zone in which the flow direction is parallel to the direction of injection of the fuel through the openings 8. The premixing fuel is thus injected transversely to the flow direction of the air at the point of fuel injection, from the outside of the 180° bend towards the inside of the bend.

Figure 5:
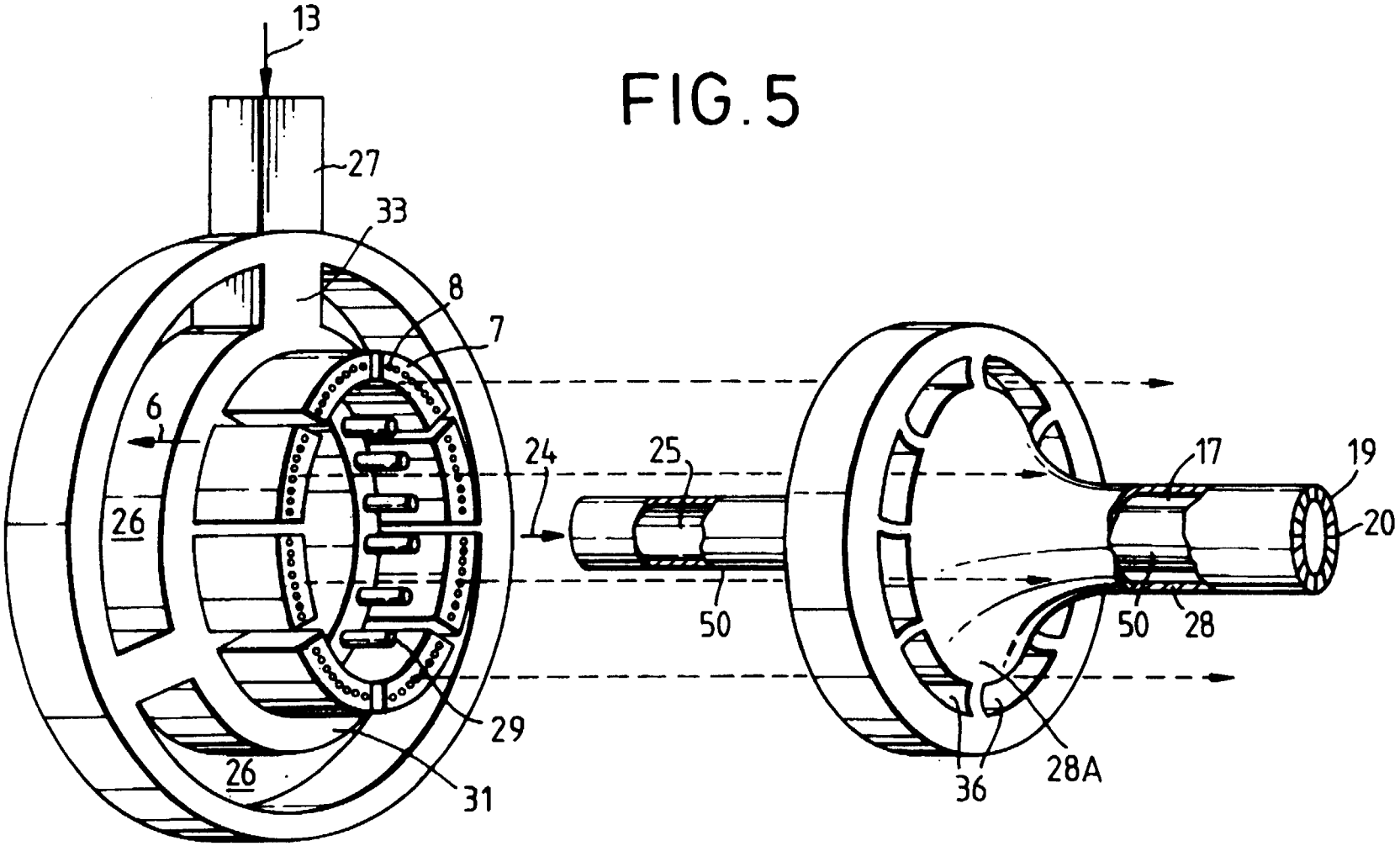
FIG. 5 is an exploded perspective view of parts of another burner for a gas turbine of the present invention, similar to that of FIG. 1.

FIG. 5 shows an exploded view of a modified version of the construction of FIGS. 1 to 4, in which corresponding parts have the same reference numbers. FIG. 5 shows how the two main components, i.e. the ring member 31 and the member 28, are secured together by the bolts 29. In this embodiment the partitions 35 are absent. The fuel nozzle bodies 7 project from the ring member 31 and are received in openings 36 of the member 28.

Figure 6:
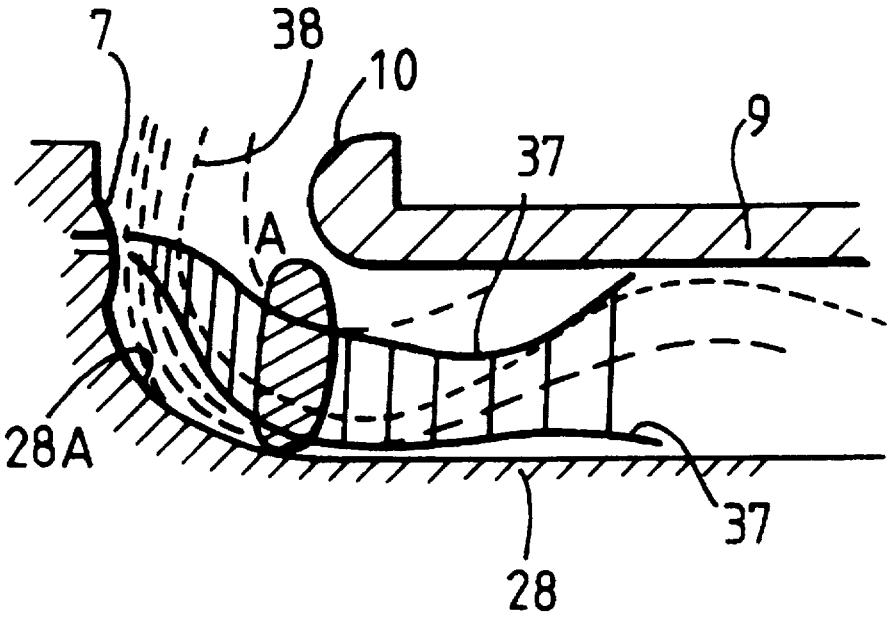
FIG. 6 is an explanatory diagram of the operation of a device of the present invention.

FIG. 6 shows the premixing fuel injection locus by solid lines 37 and the air flow in the same region by broken lines 38. The fuel locus is shown by two solid lines 37, and the majority of the fuel flows within the region between these two lines. Although the fuel locus is slightly bent in the direction of air flow by the air immediately after fuel injection, the mixing advances rapidly as turbulence becomes greater, due to the development of secondary flow in the area A following bending of the air flow itself. The air passing around the reverse bend has a velocity gradient from a high velocity region adjacent the fuel nozzle body 7 and a low velocity region adjacent the end 10 of the wall 9. The fuel is injected into the high velocity region, towards the low velocity region. FIG. 6 shows also that the air having passed around the bend flows away from the surface of the member 28 towards the inner surface of the wall 9, so that the fuel, already mixed in the air in the region A is diffused towards the surface of the wall 9, to achieve a good fuel dispersion across the entire cross section of the passage 30 at a relatively early point in time.

Figure 7:
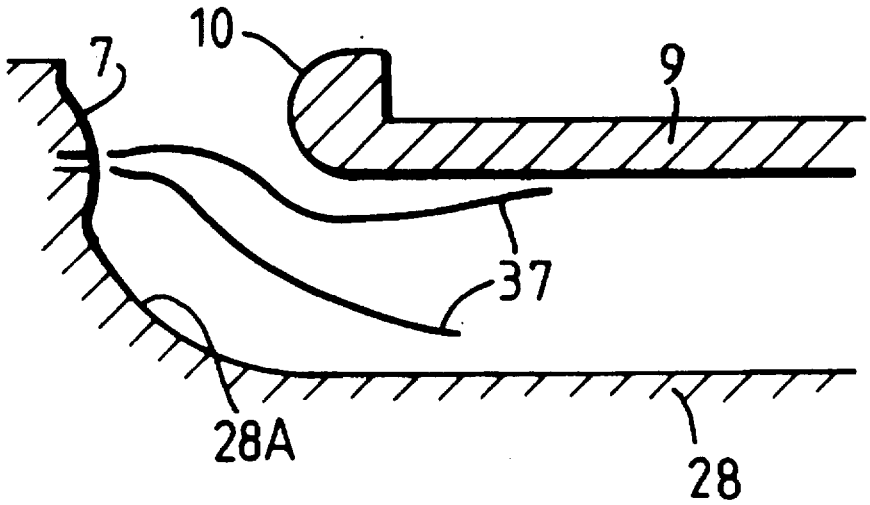
FIG. 7 is another explanatory diagram of the operation of a device of the present invention.

As FIG. 7 indicates, if the fuel is injected with a higher velocity, it penetrates immediately further into the air flow, i.e. towards the end 10 of the wall 9, and can achieve mixing with the air very rapidly.

Figure 8:
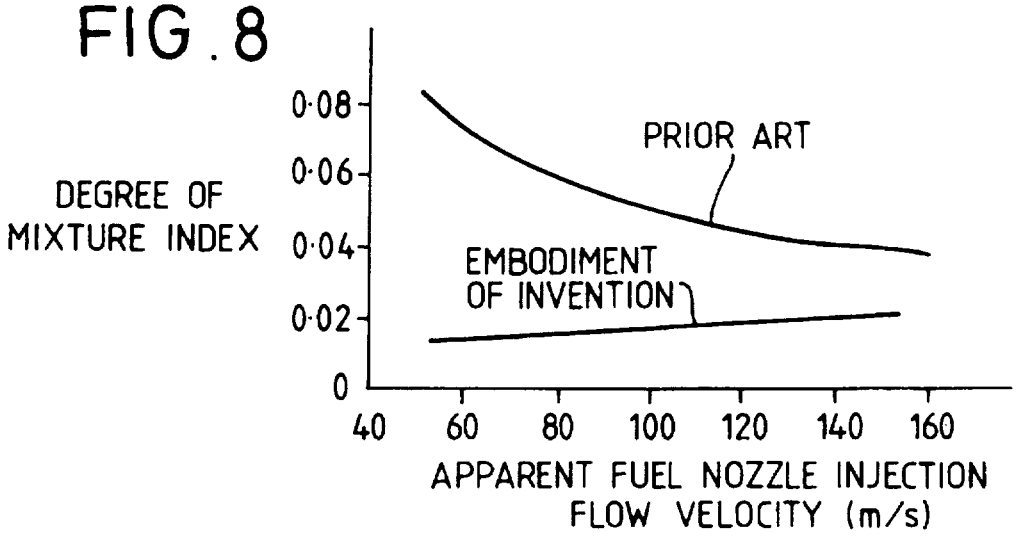
FIG. 8 is a graph showing the relation of degree of mixture against fuel injection flow velocity.
Figure 9:
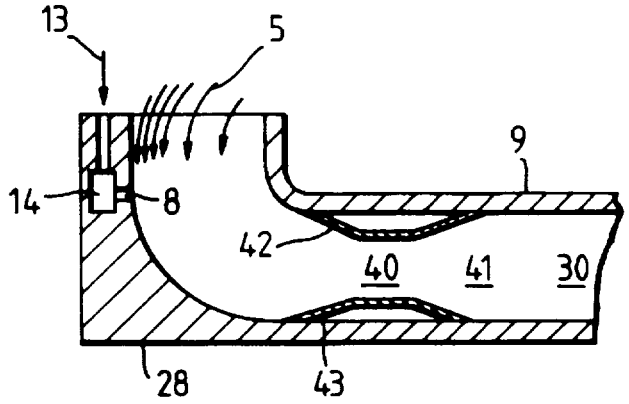
FIG. 9 is an axial cross section showing a fuel-air mixing device which is another embodiment of the present invention.

FIG. 8 shows a comparison of results of mixture experiments which were performed on a burner of substantially prior art construction (specifically the construction shown in FIG. 19 of U.S. Pat. No. 4,898,001, but without the swirl vanes 37) and the burner of present FIGS. 1 to 4. In this experiment, the concentration distribution of a tracer gas which was mixed into the premixing fuel was measured at a cross section of the air flow passage 30 located 200 mm downstream from the position of fuel injection. To evaluate the degree of mixing, the scattering in concentration at each point relative to the average concentration over the cross section was calculated as a standard deviation. This standard deviation is referred to as a mixture index. A low value indicates good mixing.

FIG. 8 shows that over a wide range of fuel nozzle injection flow velocity, the present embodiment has a smaller mixture index and therefore more uniform mixture, than the comparative construction. Particularly, mixing was poorer in the prior art embodiment, as flow velocity becomes smaller. This means that favorable mixing characteristics can be obtained according to the invention even under partial load, where the kinetic energy of the fuel is small. The improved mixing obtained by the present invention is believed to lead to a substantial reduction in NOx production during operation of the burner.

The size of the fuel injection openings 8 in the present embodiment can be selected in order to achieve optimized mixing of the fuel. For example, a combination of openings 8 of different sizes can be used. As the momentum of the fuel varies with the different size of openings 8, the width of the fuel locus can be increased, which may lead to further improvement of the fuel dispersion in the area A of FIG. 6. In addition, it is possible to supply the fuel in different amounts corresponding to local variation of the premixing air flow, by changing the diameter or the pitch of the fuel injection openings 8. In this way, a circumferentially uneven air flow distribution can be accommodated.

FIG. 8 shows that a venturi in the form of a reduced area section 40 and an area-increasing section 41 is made by installing members 42 and 43 inside the mixing zone of the passage 30, i.e. downstream of the 180° bend. Mixing of the fuel and air may be accelerated further by this construction. To minimize pressure loss, the venturi structure can have a smaller spread angle at the inlet side.

Figure 10:
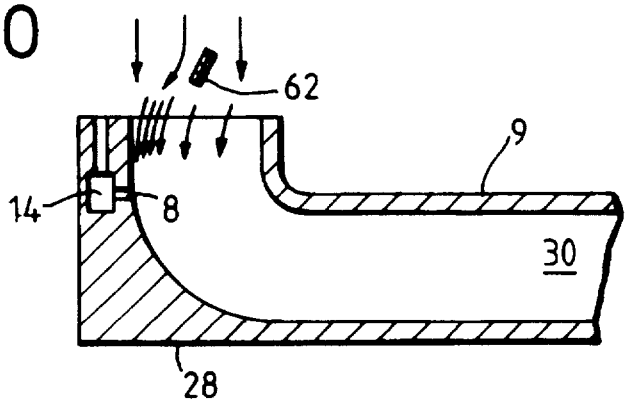
FIG. 10 is an axial cross section showing a fuel-air mixing device which is yet another embodiment of the present invention.

FIG. 10 shows an embodiment in which a deflector 62 is included in the air passage 30, in order to increase the velocity gradient across the air passage, from the fuel injection side to the opposite side. Other means, such as a projection on the wall of the passage may be employed to deflect the air.

To summarize, in the invention the gaseous premixing fuel is injected into the premixing air flow at a bend in the premixing air flow passage, in such a way that the fuel is injected transversely to the air flow from the outside of the bend towards the inside of the bend. Thus the fuel is injected into a high velocity region of the air towards a low velocity region, and is rapidly diffused into the air. It is particularly advantageous when there is a turbulent region of the air downstream of the fuel injection location. At the injection region, the air flow may be laminar. Mixing is good over a wide range of fuel injection velocity, so that a tendency towards non-uniform mixing, which may create high temperature flame regions leading to NOx production, is minimized over a wide range of load conditions. Furthermore, the construction of the burner, with the 180° bend for the premixing air flow, is compact and can be achieved in a simple manner.

While the invention has been illustrated by embodiments, it is not restricted to them. Modifications and variations are possible within the inventive concept.

What is claimed is:

1. An apparatus for mixing gaseous fuel and air for combustion, having a conduit providing a passage for flow of the air, said conduit having a reverse bend defined by opposed first and second side wall portions of said conduit bounding respectively the outside and the inside of said reverse bend as seen in a longitudinal section of said conduit, said reverse bend establishing in said conduit a flow region of said air having a velocity gradient extending transversely across said conduit from a high velocity air flow zone adjacent said first side wall portion in said reverse bend at the outside thereof to a low velocity air flow zone in said reverse bend remote from said first side wall portion, said apparatus further having means for injecting said gaseous fuel from said first side wall portion into said high velocity zone in said reverse bend with a largest velocity component transverse to the direction of the air flowing past said first side wall portion and in a direction towards said low velocity zone in said reverse bend.

2. An apparatus according to claim 1, wherein said conduit further has a mixing region for mixing of said air and said gaseous fuel downstream of said reverse bend.

3. An apparatus according to claim 2, further comprising a venturi providing a reduced cross-sectional area inside a part of an air passage in said mixing region of said conduit.

4. An apparatus according to claim 1, wherein said conduit has outer and inner concentric annular portions separated by an annular partition, said annular partition having an axial end providing said second wall portion bounding the inside of said reverse bend.

5. An apparatus according to claim 4, wherein said axial end of said partition is enlarged, relative to an adjacent part thereof separating said outer and inner concentric annular portions of said conduit.

6. An apparatus according to claim 4, wherein said axial end of said partition has a convexly curved face, viewed from inside said conduit at said reverse bend, constituting said second wall portion bounding the inside of said reverse bend.

7. An apparatus according to claim 4, wherein said means for injecting fuel comprises a plurality of apertures in said first wall portion bounding the outside of said reverse bend, arranged in a ring around the axis of said concentric annular portions of said conduit.

8. In a device for mixing gaseous fuel and air in a premixing combustion air passage of a gas turbine, having a conduit providing said air passage for the air, the improvement that said conduit has, as seen in longitudinal section of said conduit, a reverse bend around a member defining an inside turn of said bend, and means for injecting said gaseous fuel into said air flow in said reverse bend in a direction towards said inside turn of said reverse bend from an inside wall portion of said conduit opposite said inside turn.

9. A device according to claim 8, wherein said reverse bend effects reversal of the flow direction of said air from a first direction to a second direction at 180° to said first direction, and said direction of injection of said gaseous fuel is substantially parallel to said second direction.

10. A device according to claim 8, wherein said member defining said inside turn of said reverse bend is a partition separating respective upstream and downstream concentric annular portions of said conduit.

11. A combustor for a gas turbine, adapted to operate in premixing combustion mode, having a combustion zone and a conduit providing a path for supply of combustion air to said combustion zone, said path including a reverse bend defined by opposed first and second side wall portions of said conduit bounding respectively the outside and the inside of said reverse bend as seen in a longitudinal section of said conduit, said reverse bend establishing in said conduit a flow region of said air having a velocity gradient extending transversely across said conduit from a high velocity air flow zone adjacent said first side wall portion in said reverse bend at the outside thereof to a low velocity air flow zone in said reverse bend remote from said first side wall portion, said combustor further having means for injecting gaseous fuel into said combustion air from said first side wall portion into said high velocity zone at said reverse bend with a largest velocity component transverse to the direction of the air flowing past said first side wall portion.

12. A combustor according to claim 11, wherein said path for combustion air includes a mixing region for mixing of said air and said gaseous fuel downstream of said reverse bend, said largest velocity component of said gaseous fuel at said reverse bend being substantially parallel to the flow direction of said mixture of air and gaseous fuel in said mixing region.

13. A combustor according to claim 11, wherein said conduit has outer and inner concentric annual portions which join at said reverse bend, said inside of said bend being defined by an axial end of a partition separating said outer and inner annular portions.

14. An apparatus for mixing gaseous fuel and air for combustion, comprising:

a first air passage for air flow in a first direction;

a second air passage for air flow in a second direction different from said first direction of air flow;

a bend between said first and second air passages, said bend defined by an inside curved wall portion and an outside curved wall portion and providing an air flow with a velocity gradient that provides a larger air flow velocity region around said outside wall portion and a smaller air flow velocity region around said inside wall portion; and a plurality of fuel injection ports arranged so as to inject fuel into the air flow in said bend from said outside curved wall portion toward said inside curved wall portion, injected fuel and air being mixed in a fuel air mixing region downstream of said fuel injection ports.

15. An apparatus according to claim 14, wherein said first direction of air flow is opposite to said second direction of air flow, said first and second air passages are separated from each other by a partition wall member, said inside curved wall portion is formed in an end of said partition wall member, fuel being injected toward said end of said partition wall member.

16. An apparatus according to claim 14, wherein said plurality of fuel injection ports are provided on a plurality of fuel nozzle bodies each of which forms a part of said outside curved wall portion.

17. An apparatus for mixing gaseous fuel and air for combustion, comprising:

an outer cylindrical wall;

a cylindrical partition member concentrically disposed in said outer cylindrical wall to form therebetween a first air passage for air flow in a first direction;

an inner cylindrical member which is concentric with said cylindrical partition member and disposed in said cylindrical partition member to form therebetween a second air passage for air flow in a second direction opposite to said first direction;

a reverse bend formed between said first and second air passages, said reverse bend defined by an inside curved surface of an end of said cylindrical partition member and an outside curved surface of an end portion of said inner cylindrical member; and a plurality of fuel injection ports arranged in said end of said inner cylindrical member so as to inject fuel from said outside curved surface toward said inside curved surface.

18. An apparatus according to claim 17, wherein said plurality of fuel injection ports are formed in a plurality of fuel nozzle bodies each of which is fitted in grooves formed in said end of said inner cylindrical member.

19. An apparatus according to claim 18, wherein said plurality of fuel nozzle bodies each are mounted on a ring member secured to said outer cylindrical wall member, said plurality of fuel injection ports of each of said fuel nozzle bodies being open to air flow in said reverse bend.

* * * * *